United States Patent [19]

Watai et al.

[11] Patent Number: 4,828,165

[45] Date of Patent: May 9, 1989

[54] ASHTRAY

[75] Inventors: Minoru Watai; Yasukazu Nishimuro; Koichi Iwabuchi, all of Kanagawa, Japan

[73] Assignee: NEC Automation, Ltd., Kanagawa, Japan

[21] Appl. No.: 164,851

[22] Filed: Mar. 7, 1988

[30] Foreign Application Priority Data

Nov. 30, 1987 [JP] Japan ..... 62-180917[U]

[51] Int. Cl.[4] ..... A42F 19/00

[52] U.S. Cl. ..... 232/43.1; 131/231; 131/240.1

[58] Field of Search ..... 232/43.1, 43.2; 131/242, 231, 237.5, 240.1, 333

[56] References Cited

U.S. PATENT DOCUMENTS

| | | | |
|---|---|---|---|
| 4,061,149 | 12/1977 | Raczkowski | 131/231 |
| 4,148,618 | 4/1979 | Chistenson et al. | 131/231 X |
| 4,154,251 | 5/1979 | Doyel | 131/231 |
| 4,550,738 | 11/1985 | Estey | 131/241 X |

FOREIGN PATENT DOCUMENTS

| | | | |
|---|---|---|---|
| 3415545 | 10/1985 | Fed. Rep. of Germany | 131/240.1 |

*Primary Examiner*—Robert W. Gibson, Jr.
*Attorney, Agent, or Firm*—James E. Nilles

[57] ABSTRACT

An ashtray having a small electrode and a large electrode. A high voltage is applied between the two electrodes so that air is caused to flow from the small electrode to the large electrode and that the ionized particles of the smoke adhere to the large electrode. The large electrode is an ash reception plate. An auxiliary electrode is provided to connect electrically to the large electrode.

11 Claims, 2 Drawing Sheets

ASHTRAY

BACKGROUND OF THE INVENTION

1. Field of the Invention:

The present invention relates to an ashtray, particularly to an ashtray which catches smoke by attraction.

2. Description of the Prior Art:

In conventional ashtrays, a filter and a fan are provided. However, in many of the conventional ashtrays, most of the particles of the smoke of tobacco are not caught but scatter around because the diameter of each of the particles is as small as 0.3 μm or less.

SUMMARY OF THE INVENTION

The present invention was made in order to provide an ashtray which efficiently catches the smoke of tobacco put thereon, to keep the smoke from scattering around.

Accordingly, it is an object of the present invention to provide an ashtray comprising an ash reception plate; a small electrode provided over the ash reception plate at a distance therefrom; an auxiliary electrode opposed to the small electrode; a large electrode electrically coupled to the auxiliary electrode; and a mechanism for applying a high voltage between the small electrode and the auxiliary electrode and between the small electrode and the large electrode.

It is still further object of the present invention to provide an ashtray comprising a base having an upper opening; and ash reception plate mounted detachably on the bottom surface of said base; a cover pivoted rotatably on said base for closing the upper opening of said base; a guide member engaged detachably with said cover; a small electrode provided on said guide member so as to face the upper surface of said ash reception plate; a frame electrode provided on said guide member adjacent said small electrode; a plate electrode provided on said guide plate so as to face a side surface of said ash reception plate; and a mechanism for applying a high voltage between said electrodes.

A further object and characteristics of the present invention will now be explained with reference to the attached drawings.

DESCRIPTION OF THE PREFERRED EMBODIMENTS

Figure 1:
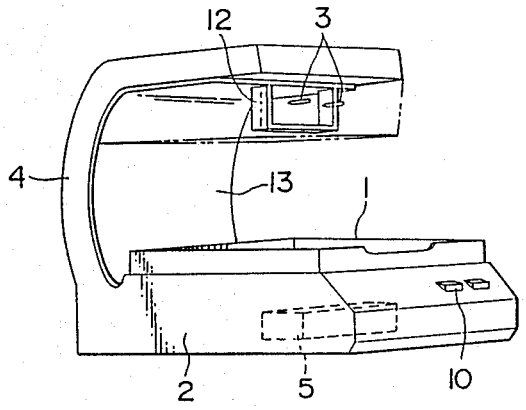
FIG. 1 shows a perspective view of an ashtray which is an embodiment of the present invention.
Figure 2:
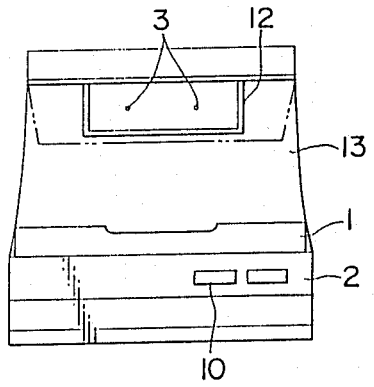
FIG. 2 shows a front view of the ashtray.
Figure 3:
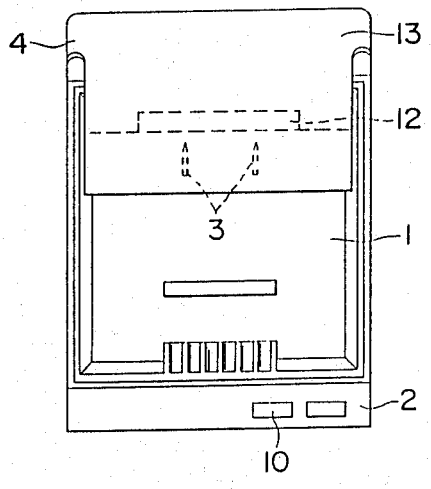
FIG. 3 shows a plan view of the ashtray shown in FIG. 1.

FIGS. 1, 2 and 3 show an ashtray which is a first embodiment of the present invention and has an ash reception plate 1 and a base 3 therefor. The ash reception plate 1 constituting a large electrode is made of an electroconductive material such as a metal plate (large electrode). Needle-like electrodes 3 constituting small electrodes are provided over the ash reception plate 1 at a distance therefrom and held by an arm 4 on the base 2. A high voltage from a high-voltage power supply 5 provided in the base 2 is applied between the ash reception plate 1 and the needle-like electrodes 3 through an insulated electric wire not shown in the drawings.

In the ashtray, a frame-like electrode 12 constituting an auxiliary electrode, whose cross section is oblong or circular, is provided beside needle-like electrodes 3 at a distance therefrom. A plate electrode 13 constituting a large electrode bent as U-shape or as arc is integrally coupled to the frame-like electrode 12 so that the flat or curved surface of the plate electrode 13 faces the side surface of an ash reception plate 1. A high voltage from a high-voltage power supply 5 provided in a base 2 is applied between the needle-like electrodes 3 and the frame-like electrode 12 or the plate electrode 13 through an insulated electric wire not shown in the drawings.

Figure 4:
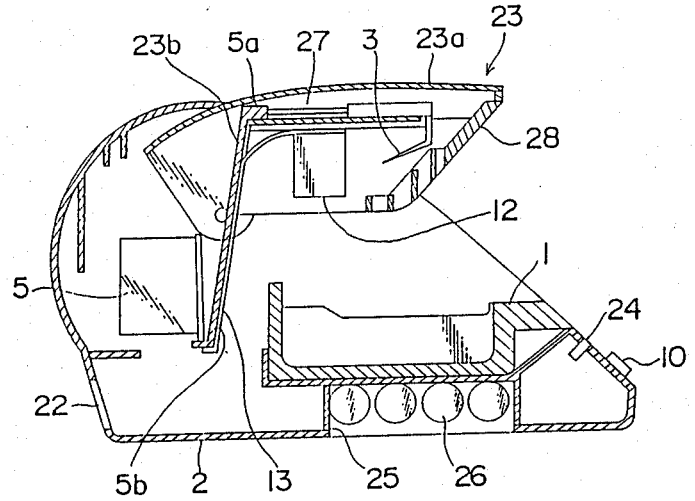
FIG. 4 shows a longitudinally sectional side view of an ashtray which is still another embodiment of the present invention.

FIG. 4 shows the high-voltage power supply 5 in which a DC voltage of 12 V is converted into a high-frequency signal by an oscillation circuit 6; the high-frequency signal is applied to the primary coil of a boosting transformer 8 through a feedback circuit 7; and an AC voltage of 5.0 kV from the secondary coil of the transformer 8 is rectified by a voltage doubler rectifier 9 to produce a DC output voltage of 6.5 kV, for example. A commercial AC voltage may be used instead of the DC voltage of 12 V. The AC voltage from the secondary coil of the boosting transformer 8 may be directly applied between the electrodes 1 and 3 instead of the DC output voltage of 6.5 kV.

Shown at 10 in FIGS. 1, 2 and 3 is a push-button power switch provided in a circuit through which the DC voltage of 12 V is applied to the oscillation circuit 6. When the transparent push button of the switch 10 is pressed, a lamp inside the push button is lit so that it is possible to confirm by eyesight whether the switch 10 is turned on or off.

When the switch 10 is pressed and the high voltage is applied between the ash reception plate (large electrode) 1 and the needle-like electrode (small electrodes) 3, air is caused to flow from the needle-like electrodes 3 toward a flow of ions from the needle-like electrodes 3 toward the central portion of the frame-like electrode 12 is caused and the flow further proceeds along the plate electrode 13. The smoke of tobacco put on an ash reception plate 1 is caused to flow from the ash reception plate 1 toward the plate electrode 13 along with the flow of the ions so that the ionized particles of the smoke are caught on the surface of the plate electrode 13 by an electrostatic force. The smoke of the tobacco is thus prevented from scattering around the ash reception plate 1. Therefore, the purpose is surely attained.

Figure 5:
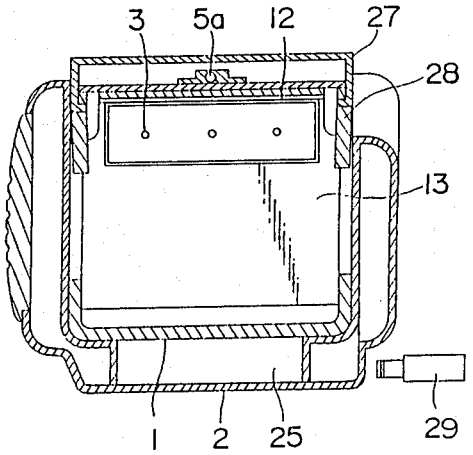
FIG. 5 shows a longitudinal sectional front view of the ashtray shown in FIG. 4.
Figure 6:
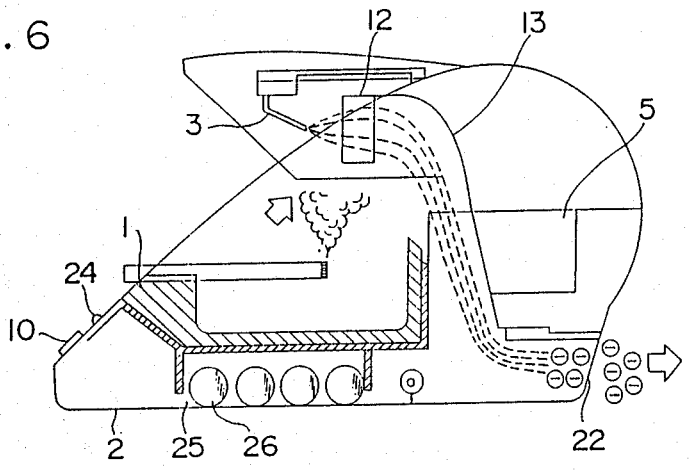
FIG. 6 shows an explanatory perspective view thereof.

In a further embodiment, as shown in FIGS. 4 and 5, an insulating ash reception plate 1 is mounted detachably on the bottom surface of a box-shaped base 2 having an upper opening, and a cover 23 comprising a horizontal plate 23*a* for closing the upper opening of said base 2 and a vertical plate 23*b* is pivoted rotatably on the rear portion of said box-shaped base 2 at the substantial central portion of said vertical plate 23*b*. A DC power supply 5 of several KV is fixed on the back of said vertical plate 23*b*, a cathode terminal 5*a* of the power supply 5 is provided on the lower surface of the horizontal plate 23*a* of said cover 23 and an anode terminal 5*b* is provided on the front surface of the vertical plate 23*b*.

Guide plates 27 extending in the lower direction are formed at both sides of the horizontal plate 23*a* of said cover 23. An insulating guide plate 28 is engaged slidably with the cover 23 along the guide plates 27. A small electrode, such a needle-like electrode 3 is provided detachably on said insulating guide plate 28 so as to face the upper surface of said ash reception plate 1. So that a needle-like electrode 3 is brought into contact with said cathode electrode 5*a* of said power supply 5.

An annular or rectangular frame electrode 12 is provided at a portion backwards of the needle-like electrode 3 on the intermediate lower surface of said guide plate 28 and a plate electrode 13 extending in the lower direction is connected to said annular frame electrode, so that in the state that the guide plate 28 is mounted on the opening and closing cover 23 said plate electrode 13 is brought into contact with the anode terminal 5*b* of said power supply 5 and faced to a side surface of said ash tray 1.

Further, an opening 22 communicating with an upper portion of said ash reception plate 1 is provided on a lower back portion of the base 2.

A time (not shown) is provided for maintaining ON state of a power switch 10 through a predetermined time, such as five minutes when the power switch 10 is turned on. The power switch 10 is automatically turned off after the predetermined time has passed. Reference numeral 24 denotes a lamp for indicating the ON state of the power switch 10, 25 a battery case and 26 batteries.

In this embodiment, such means may be provided that the power switch 10 is automatically turned on when said cover 23 is opened and turned off when said cover 23 is closed.

As said high-voltage power supply 5, a commercial AC voltage with AC adaptor 29 may be used instead of the DC voltage of 12 V.

In this embodiment, when the cover 23 is opened and the switch 10 is pressed and the high voltage is applied between the frame electrode 12 or the plate electrode 13 and the needle-like electrode 3, ion is caused to flow from the needle-like electrodes 3 toward the plate electrode 13 through the center of the frame electrode 12 as shown in FIG. 17 so that the smoke of tobacco put on the ash reception plate 1 is risen from the ash recepjtion plate 1, flows along said ion flow and said plate electrode 13 and discharged from the lower opening 22, while the ionized particles of the smoke adhere to the surface of the plate electrode 13 due to an electrostatic force. Therefore, the smoke of the tobacco does not scatter around the ash reception plate 1. The purpose is thus surely attained.

In each of the above-described embodiments, the needle-like electrodes 3 may be made up of either a single electrode or a plurality of electrodes spaced apart one another. The electrodes 3 may also be shaped as a ball, a rod, a spicule or saw teeth. The frame-like electrode 12 may be reticulate. The plate electrode 13 may have projections and recesses or be reticulate.

Each of the above-described ashtrays provided in accordance with the present invention has a large advantage that the smoke of tobacco is efficiently attracted and caught without using a fan and expendables such as a filter.

I claim:

1. An ashtray comprising an ash reception plate; a small electrode provided over said ash reception plate at a distance therefrom; an auxiliary electrode opposed to said small electrode; a large electrode electrically coupled to said auxiliary electrode; and a mechanism for applying a high voltage between said small electrode and said auxiliary electrode and between said small electrode and said large electrode.

2. An ashtray according to claim 1, in which the large electrode is a plate having a curved surface located beside the ash reception plate.

3. An ashtray according to claim 1, in which the large electrode is a cylindrical member surrounding the small electrode.

4. An ashtray according to claim 1, in which the auxiliary electrode is a frame-like electrode.

5. An ashtray according to claim 1, in which the auxiliary electrode consists of parallel plate electrodes.

6. An ashtray comprising a base having an upper opening; an ash reception plate mounted detachably on the bottom surface of said base; a cover pivoted rotatably on said base for closing the upper opening of said base; a guide member engaged detachably with said cover; a small electrode provided on said guide member so as to face the upper surface of said ash reception plate; a frame electrode provided on said guide member adjacent said small electrode; a plate electrode provided on said guide member so as to face a side surface of said ash reception plate; and a mechanism for applying a high voltage between said electrodes.

7. An ashtray according to claim 6, in which the plate electrode is connected to said frame electrode.

8. An ashtray according to claim 6, in which the small electrode is a needle-like electrode.

9. An ashtray according to claim 6, in which the frame electrode is annular.

10. An ashtray according to claim 6, in which the frame electrode is rectangular.

11. An ashtray according to claim 6, in which the small electrode is opposed to an ash reception plate.

* * * * *